United States Patent [19]

Pappas et al.

[11] Patent Number: 5,001,469

[45] Date of Patent: Mar. 19, 1991

[54] WINDOW-DEPENDENT BUFFER SELECTION

[75] Inventors: James L. Pappas, Leominster; Larry D. Seiler, Boylston; Robert C. Rose, Hudson, all of Mass.

[73] Assignee: Digital Equipment Corporation, Maynard, Mass.

[21] Appl. No.: 212,819

[22] Filed: Jun. 29, 1988

[51] Int. Cl.[5] ..... G09G 5/14

[52] U.S. Cl. ..... 340/721; 340/723; 340/798; 340/799; 364/518

[58] Field of Search ..... 340/721, 723, 724, 798, 340/799, 750, 747; 364/518, 521, 522

[56] References Cited

U.S. PATENT DOCUMENTS

| | | | |
|---|---|---|---|
| 4,439,760 | 3/1984 | Fleming | 340/799 |
| 4,484,187 | 11/1984 | Brown et al. | 340/724 |
| 4,493,078 | 1/1985 | Daniels | 371/25 |
| 4,496,944 | 1/1985 | Collmeyer et al. | 340/750 |
| 4,509,043 | 4/1985 | Mossaides | 340/721 |
| 4,545,070 | 10/1985 | Miyagawa et al. | 382/48 |
| 4,577,318 | 3/1986 | Whitacre | 371/1 |
| 4,631,724 | 12/1986 | Shimizu | 361/21 |
| 4,642,790 | 2/1987 | Minshull et al. | 364/900 |
| 4,651,146 | 3/1987 | Lucash et al. | 340/750 |
| 4,670,752 | 6/1987 | Marcoux | 340/721 |
| 4,679,038 | 7/1987 | Bantz et al. | 340/750 |
| 4,688,033 | 8/1987 | Carini et al. | 340/799 |
| 4,694,288 | 9/1987 | Harada | 340/721 |
| 4,710,767 | 12/1987 | Sciacero | 340/799 |
| 4,716,460 | 12/1987 | Benson et al. | 340/750 |
| 4,749,947 | 6/1988 | Gheewala | 324/73 R |
| 4,772,881 | 9/1988 | Hannah | 340/703 |
| 4,862,154 | 8/1989 | Gonzalez-Lopez | 340/747 |
| 4,864,517 | 9/1989 | Maine et al. | 340/747 |
| 4,868,552 | 9/1989 | Chang | 340/721 |

*Primary Examiner*—Alvin E. Oberley
*Assistant Examiner*—Richard Hjerpe
*Attorney, Agent, or Firm*—Nutter, McClennen & Fish

[57] ABSTRACT

An image generator (38) in a workstation draws its image data from a pair of frame buffers (32 and 34). The selection between the frame buffers is made by a multiplexer circuit (42) that can switch between frame buffers (32 and 34) on a pixel-by-pixel basis, i.e., different frame buffers can be used during different parts of the same scan frame of a monitor (18) in the image generator (38). A selection-signal source (46), which provides the selection signals for the multiplexer circuit (42), includes a window detector (56), which compares the outputs of counters (72 and 74) that represent the monitor scan position with the outputs of registers (62, 64, 66, and 68) that represent the boundaries of windows used by respective applications that the workstation is running. The source (46) thereby identifies the windows in which the pixel currently being displayed is located, and it employs a priority circuit (76) to identify the one such window having the highest priority. Each software application deposits in a buffer register (70) the identity of the frame buffer (32 or 34) from which the data for its display should currently be drawn, and a priority circuit generates a BUFSEL signal to identify the buffer designated by the application associated with the highest-priority window. It uses BUFSEL to control the multiplexer circuit (42). In this way, all applications do not have to switch between buffers at the same time, so the complexity and lack of flexibility imposed by synchronizing between applications is avoided.

11 Claims, 12 Drawing Sheets

WINDOW-DEPENDENT BUFFER SELECTION

BACKGROUND OF THE INVENTION

The present invention is directed to video-display workstations and terminals, particularly those whose display subsystems employ double buffering.

Workstations are high-performance computer systems that typically employ high-resolution graphic displays to display the results of the applications that they run. An application that a workstation runs may generate an animated display as its output; that is, it may repeatedly process information, generating different results each time, and these results are displayed in succession to give the illusion of motion. For instance, the workstation may compute the orbit of a planet around a star and the simultaneous motion of a satellite around a planet. It computes the effects of the various gravitational forces at successive time increments and displays the result of each time increment so as to provide an animated display of the planetary motion. The application requires not only the computation of different positions but also the computation of how the results should be depicted on the display, and it is convenient in a high-performance workstation to be able to deposit the results directly into the frame buffer. i.e., into the high-speed memory from which image data are retrieved in real time to drive the monitor's electron gun as the monitor is scanning its screen.

However, the results can be misleading if the user can see partial results. For instance, the application may compute the motion of the planet first and then that of the satellite. If it writes the results of the planet computation into the frame buffer first and then computes the satellite position, the new planet position may be displayed before the new satellite position, and this may give the misleading impression that the planet is leaving the satellite behind. Accordingly, the application would have to make provisions for storing the intermediate result in a location other than the frame buffer until the new position of the satellite is also computed. Furthermore, even with all of the new position information computed and the new images to represent those positions determined, it may not be possible to write the entire computed image into the frame buffer within the vertical blanking time of the monitor. Accordingly, the user sees each separate frame being "painted" onto the screen, and this may be undesirable.

In order to avoid this result, the work station can use double buffering, in which one frame buffer is used as the source of the video data while the application is writing a new image in a second frame buffer. When the new image has been completely written into the second frame buffer, the monitor can be switched from the first frame buffer as its image-data source to the second frame buffer, and a completely drawn image is always displayed on the screen.

Because of its avoidance of incomplete images, the double-buffer arrangement has many advantages. However, it does present some software complexity and detracts from software flexibility in windowing situations. A workstation often runs more than one application at a time and needs to display the results of several or all of them on the same monitor simultaneously. For this reason, "windows" are used; for instance, the output from one application may be displayed as a sort of background on the screen, while a small window on the screen occludes part of the background to display as a foreground image the results of a second application. That is, one application writes its results into an area of the frame buffer assigned to that application, while the other writes its results into another portion of the buffer.

Clearly, both of the applications can display in an animated fashion, and they can employ the double-buffering organization to avoid displaying partial results. But it adds significant complexity to do so because the two applications must be synchronized. Specifically, one application cannot simply require that the monitor switch frame buffers; it must also in some fashion communicate with the other application—possibly through a higher-level synchronizing program—to determine whether the other application has completed writing in the frame buffer to which the first application is ready to have the monitor be switched. This not only adds complexity but also detracts from flexibility, because a fast-operating application, which can generate new images at a rapid rate, is constrained to display those new images only at the rate of its slower companion application.

Summary of the Invention

The present invention increases flexibility and reduces the need for software complexity in double-buffered window situations by making the frame-buffer selection dependent, on a pixel-by-pixel basis, on the identity of the window to which the pixel currently being displayed belongs. Specifically, a plurality of frame buffers are operated in synchronism with an image generator—i.e., with a monitor and supporting circuitry—so as to provide image data at the time at which the monitor needs the data to generate the image on its screen. A multiplexer receives the outputs of the frame buffers, and it also receives a selection signal from a selection-signal source. The selection signal determines which frame-buffer outputs the multiplexer is to select as its own output.

As a result, the several applications do not have to be synchronized with each other, since the applications do not necessarily draw their image data from the same frame buffers.

Brief Description of the Drawings

These and further features of advantages of the present invention are described in connection with the accompanying drawings, and which.

DETAILED DESCRIPTION OF THE PREFERRED EMBODIMENT

Figure 1:
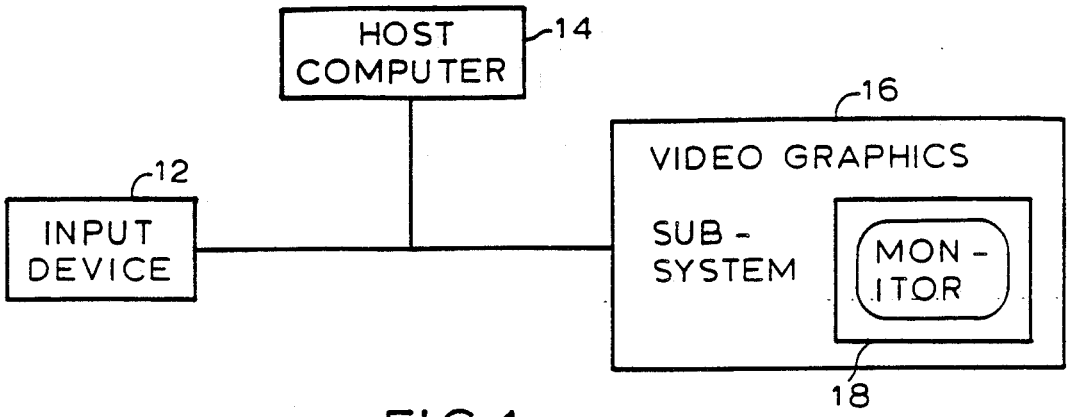
FIG. 1 is a block diagram of a video-display workstation.

FIG. 1 depicts a workstation of the type typically used, for instance, for computer-aided engineering or design. The workstation typically includes an input device 12 such as a keyboard or mouse 12 by which the user communicates with the system. A general-purpose host computer 14 coupled to the input device serves as the main data processing unit of the system. A video graphics subsystem 16 receives data and graphics commands from the host computer 14 and processes these data to form an image on an included monitor 18 to represent the output of high-level applications performed by the host. The workstation may have several applications running simultaneously, and their results are to be displayed in separate "windows" on the display. The present invention enables the several windows to be displayed with considerably less software overhead and considerably more software flexibility.

Figure 2:
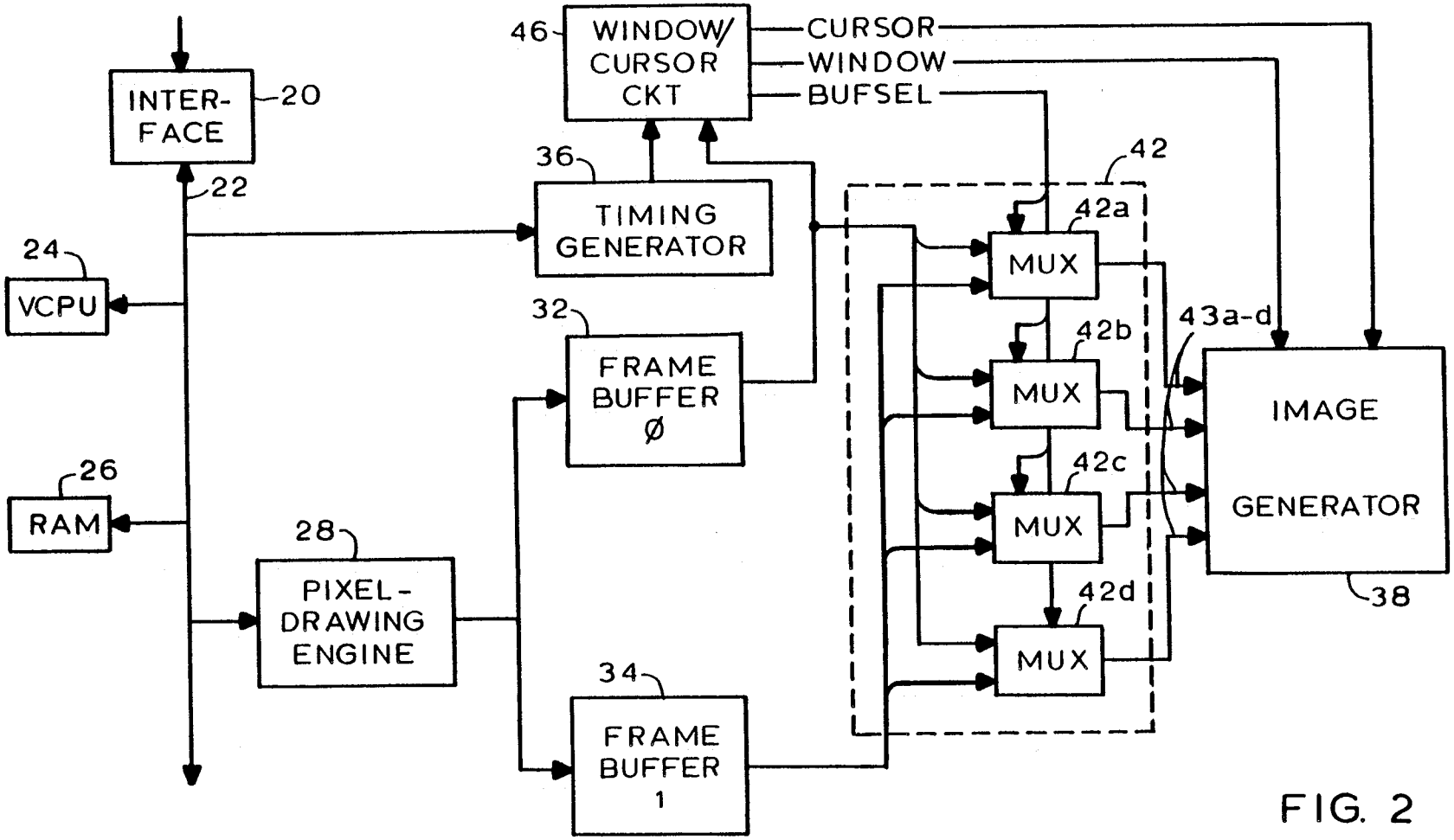
FIG. 2 is a block diagram of the graphics subsystem of the workstation.

FIG. 2 depicts the graphics subsystem 16 in more detail. An interface unit 20 receives signals from the host computer 14 and converts them to the proper form for transmission over a bus 22 to a processor 24 dedicated to the graphics function. The processor would typically be provided with memory 26, also coupled to the bus 22, for intermediate storage of data that the processor 24 has processed.

A graphics subsystem may also include a pixel-drawing engine 28, whose purpose is to write information into and cause information to be fetched from two frame buffers 32 and 34 in accordance with timing information from timing circuitry 36. In the alternative, processor 24 could perform that function directly, although it would typically not be as fast. Circuitry similar to all of these elements are provided in many existing graphics systems and will not be discussed in detail. Although they are not necessary for an understanding of the present invention, the following five U.S. patent applications, which we filed on June 13, 1988, describe devices of this type for use in conjunction with the present invention: U.S. Pat. Application Ser. No. 205,030 for an Apparatus and Method for Specifying Windows with Priority Ordered Rectangles in a Computer Graphics System; U.S. Pat. application Ser. No. 206,194

- Data Path Chip Architecture; U.S. Pat. Application Ser. No. 206,031 for
- Window Dependent Pixel Datatypes in a Computer Video Graphics System; U.S. application Ser. No. 206,203 for a
- Semaphore Controlled Video Chip Loading in a Computer Video Graphics System; and U.S. application Ser. No. 206,026
- Pixel Look-Up in Multiple Variably-sized Hardware Virtual Colormaps in a Computer Video Graphics System.

We hereby incorporate these applications by reference.

Each of the two frame buffers 32 and 34 contains data representing a separate image. The pixel-drawing engine 28 provides address and control signals to both of the frame buffers 32 and 34 in such manner that they apply to an image generator 38 image-data signals representing the values of pixels (picture elements) that together make up the image. The image generator 38 includes the high-resolution workstation monitor 18, which scans its screen in a conventional raster-scan fashion, completing a vertical scan every sixtieth of a second. The timing generator 36 synchronizes the monitor sweep with the fetching of data from the frame buffers 32 and 34, which operate simultaneously. Data are fetched from frame buffers 32 and 34 in the illustrative embodiment only once every four pixel times; if new data were fetched every single pixel time, the transmission difficulties would be considerably greater. Consequently, to keep up with the monitor, each frame buffer 32 and 34 produces as its output the data for four pixels at a time.

Although both frame buffers 32 and 34 are operated simultaneously and both produce data for each pixel, the monitor uses the data from only one frame buffer for each pixel. To choose between the two buffers, a multiplexer circuit 42 is employed. The multiplexer circuit 42 actually includes four parallel multiplexers 42*a–d*. The first frame buffer 32 applies signals representing four pixel values to respective input ports of the four multiplexers 42*a–d*. The other input port of each of the four multiplexers 42*a–d* receives the image data for a respective one of the four pixels whose input data are generated simultaneously by the other frame buffer 34. A window/cursor circuit 46 acts as a selection-signal source, and it selects, independently for each of the multiplexers 42*a–d*, the input whose signal the respective multiplexers will forward as their output to the image generator 38.

The image generator 38 and window/cursor circuit 46 include numerous registers, as will be explained below. In addition to containing image data, frame buffer 32 may also include data that the applications have written into them for forwarding to those registers. Specifically, frame buffer 32 includes more memory than is needed for a full screen, and it continues to fetch data from the extra, "off-screen" portion during vertical blanking. These data can be loaded into the registers by means omitted from the drawing for the sake of simplicity. The patent applications incorporated by reference above describe suggested methods for loading these registers, but the specific method employed is not pertinent to the present invention. What is pertinent to some aspects of the invention is that the method used preferably enables the registers to be loaded between frames as the image is displayed so that the window boundaries can change from frame to frame.

According to the present invention, the window/cursor circuit 46 operates the multiplexer circuit 42 so as to choose between the two frame buffers 32 and 34 on a pixel-by-pixel basis; that is, it can switch between the buffers in such a manner that part of the image written during one vertical scan of the monitor represents the contents of frame buffer 32 while the other part of the image represents the contents of the other of the frame buffers 32 and 34. In this way one application can switch to a buffer into which it has completed writing and not wait for the other application to finish writing into that buffer, too.

Figure 3:
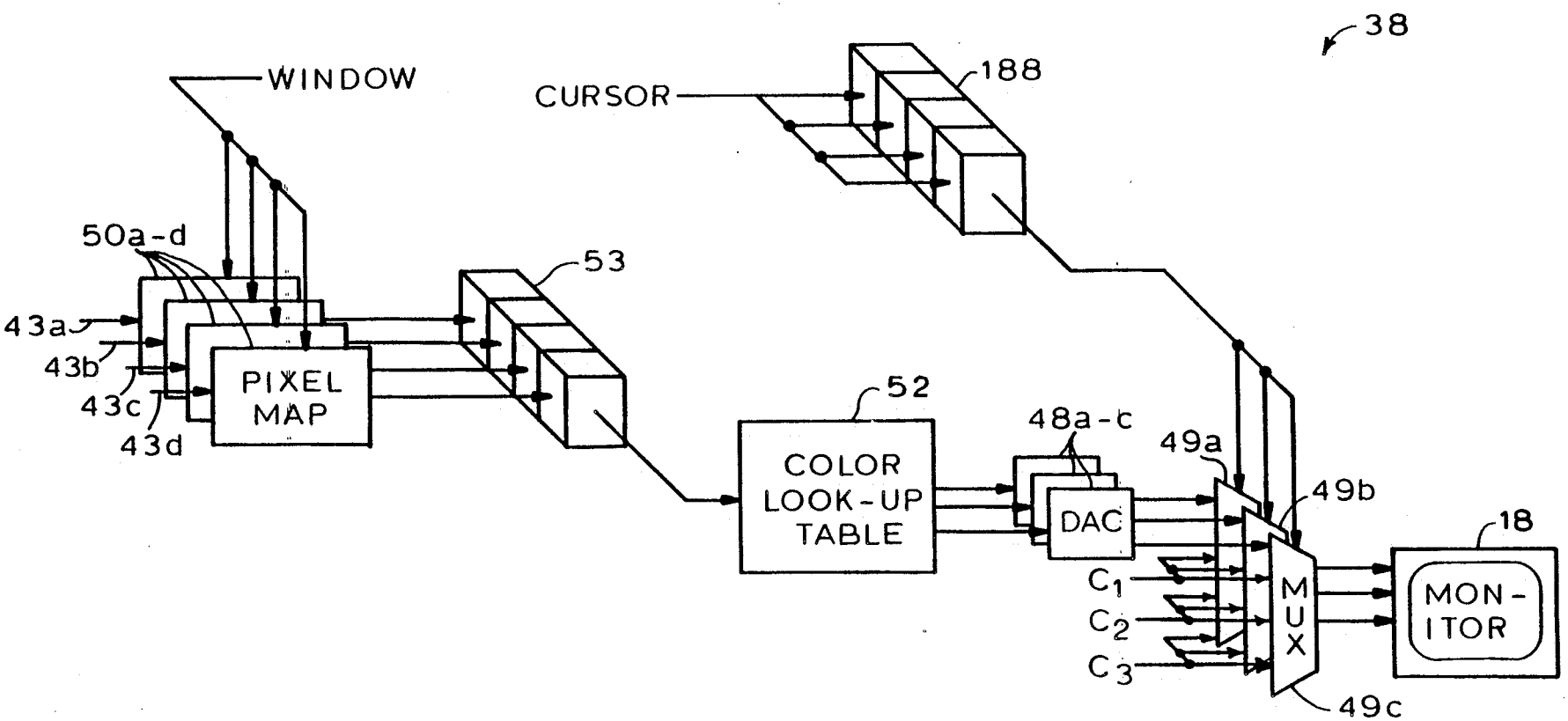
FIG. 3 is a block diagram of the image-generation circuitry of the workstation.

As FIG. 3 shows, the image generator 38 includes three digital-to-analog converters 48*a–c*, each of whose outputs is normally applied by a respective multiplexer 49*a, b*, or *c* to a respective one of the red, green, and blue electron guns in the monitor 18. The digital-to-analog converters 48*a–c* have a high resolution; that is, the digital input that specifies the analog output consists of a relatively large number of bits. However, the frame buffers 32 and 34 may contain a somewhat lower number of bits for each pixel and so may be able, at any one time, to choose from only a subset of the possible inputs to the digital-to-analog converters 48*a–c*. The mechanism for specifying just what subset this is at any given time is the combination of four pixel maps 50*a–d* (one for each of the pixels for which the frame buffers 33 and 34 produce image data simultaneously) and a color look-up table 52. Exemplary forms of the pixel maps and color look-up table are described in our U.S. Pat. application Ser. No. 211,778 for Pixel Data Formatting, filed on June 27, 1988, and in U.S. Pat. application Ser. No. 212,834 for Extendable-Size Color Look-Up Table for Computer Graphics System, filed on even date herewith. Both applications were assigned to the assignee hereof. We hereby incorporate those applications by reference.

If each of the frame buffers is eight planes deep, the output of multiplexer 42*a* consists of eight bits, which are applied as inputs to pixel map 30*a*. Pixel map 50*a* processes the eight-bit value, such as by adding a constant or performing some other operation, in a manner that typically differs in accordance with the identity of the window that contains the pixel currently being displayed. For this reason, the pixel map receives from window/cursor circuit 46 signals identifying that window. In response to the window-identifying signals and its eight-bit input, pixel map 30*a* may generate, for instance, three eleven-bit outputs, one for each color. It applies these outputs in parallel with those from the other pixel maps 50*b–d* to a parallel-to-serial converter 53, which transmits the four outputs of the pixel maps serially to the color look-up table 52. That is, the parallel-to-serial converter 53 produces outputs with a period equal to the monitor pixel interval rather than with a period four times that long, as the preceding circuitry does.

The output of each of the look-up table 52 consists of three digital values, which represent respective relative intensities of the red, green, and blue components of the color image. These values are applied to respective digital-to-analog converters 40*a-c*, as was mentioned above, which convert these values to analog form and apply them to respective multiplexers 49*a-c* and thereby to the electron guns of the high-resolution monitor 18 to form an image.

According to one aspect of the present invention, the window/cursor circuit 46 determines the value of the buffer-selection signals that it applies to the multiplexer circuit 42 by comparing the current monitor scan location (i.e., the current pixel address) with the window boundaries set by the applications that the workstation is running. As was stated above, several software applications may be operating concurrently, and the user may want the displays for the several applications to be shown on the screen simultaneously. Accordingly, the workstation software will define windows on the monitor as well as priorities for those windows. That is, an application with a higher-priority window may appear to be lying on top of the window that displays the output of another application. In such a situation, the higher-priority window will occlude the lower-priority window in that part of the screen area, if any, that the two windows have in common.

Figure 4:
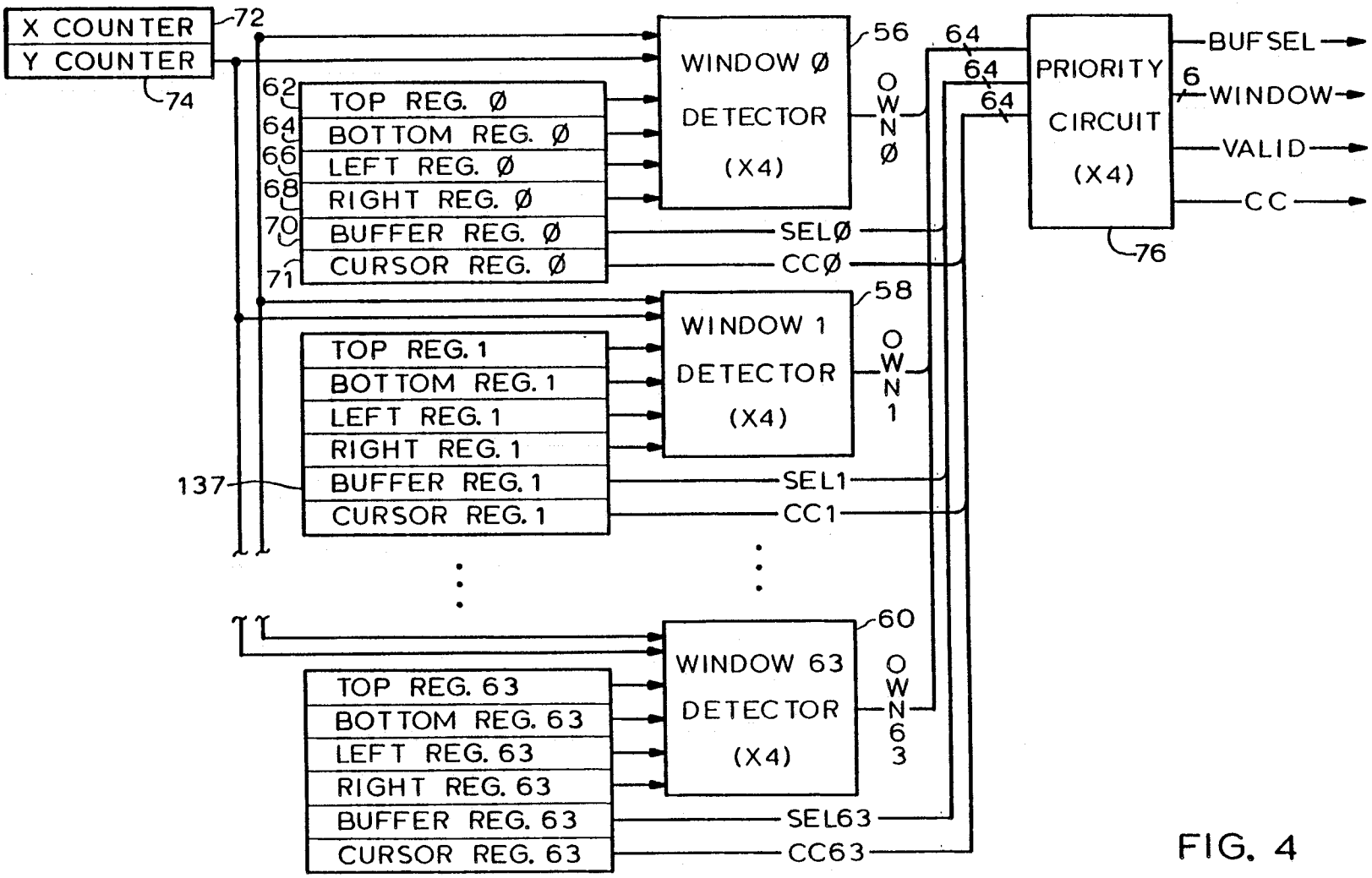
FIG. 4 is a block diagram of the selection-signal source of that subsystem.

FIG. 4 depicts relevant parts of the window/cursor circuit 46 in more detail. An exemplary window/cursor circuit 46 may include, for instance, sixty-four window detectors, of which FIG. 4 shows three detectors 56, 58, and 60. Each detector is associated with a different window. Associated with window detector 56 are four boundary registers 62, 64, 66, and 68, into which the application can write the positions of the upper, lower, left, and right window boundaries, respectively. Also associated with window detector 56 is a buffer register 70, which specifies the frame buffer 32 or 34 from which the particular application employing that window has indicated that its display should be drawn. A further, cursor register 71 may also be included to indicate whether a cursor will be permitted to be displayed, as is described in more detail in our U.S. Pat application Ser. No. 213,197 for Sprite Cursor with Edge Extension and Clipping, which was filed on even date herewith and assigned to the assignee hereof. That application is hereby incorporated by reference.

Window detector 56 receives the outputs of the boundary registers 62, 64, 66, and 68 as well as the outputs of an X counter 72 and a y counter 74. Counters 72 and 74 count in response to timing signals that the timing circuitry 16 (FIG. 1) applies to them by means of connections not shown, and they accordingly generate the address (with the X coordinate divided by four, as will be explained below) of the four pixels whose data are currently being processed. In response to these inputs, window detector 56 indicates whether the current pixel is located in the window defined by registers 62, 64, 66, and 68.

Window detector 56 in the drawings can be thought of as four detectors, all of which are associated with the same window and receive the outputs of the same four boundary registers, but the four registers make their determinations with respect to different ones of the four pixels whose data are processed simultaneously. That is, the first of the four detectors represented by detector 56 determines whether one pixel is located in "window 0," the next detector determines whether the adjacent pixel is located in that window, and the other two detectors determine whether the next two pixels are located within that window. The Y counter generates as its output the actual Y address of the current pixel, but the X counter generates as its output the X address divided by four—i.e., the X address with the two least-significant bits omitted. In a manner to be described below in connection with FIGS. 7A–D, two least-significant bits of the X address are hard wired separately for the four window detectors as 00, 01, 10, and 11, respectively.

Window detector 56 operates by comparing the outputs of the top and bottom registers 62 and 64 with the output of the Y counter 74 and by comparing the output of the X counter 72, supplemented with the hard-wired two least-significant bits, with the outputs of the left and right registers 66 and 68. If the Y position is between the top and bottom values and the X position is between the left and right values, window detector 56 concludes that the scan is now within the window with which detector 56 is associated and so asserts its one-bit OWN0 signal to indicate this fact.

In the illustrative embodiment, there are only two possible image-data sources, namely, frame buffers 32 and 34, so the output of the buffer register 70 consists only of a single bit. The cursor register 71 also consists of only a single bit. In one implementation of the present invention, therefore, the buffer and cursor registers 70 and 71 are not implemented in separately addressable registers; instead, each is included as one of the bits in one of the boundary registers 62, 64, 66, and 68. However, this arrangement is not necessary, so registers 70 and 71 are shown separately in the drawing because of their separate functions.

We have embodied the circuitry of FIG. 4, together with certain other functions, on a single chip having the single-bit buffer register as part of one of the boundary registers, as was just described. The single-bit buffer register is used to select between two image-data sources such as frame buffers 32 and 34. However, it is clear that the teachings of the present invention can be employed in workstations that include more than two image-data sources. In such cases more than a single bit of buffer selection is needed, so a plurality of such chips can be arranged in parallel. The same boundary information would be stored in all the chips, but the buffer-select information in the different chips would not in general be the same, and the buffer-selection-bit locations in the several chips would together constitute a multi-bit buffer-selection register to select among more than two buffers.

Window detector 58 and all of the window detectors through the last window detector 68 also have respective boundary, buffer, and cursor registers associated with them, and they receive corresponding signals from their respective boundary registers, together with the outputs of the X and Y counters, to determine whether the monitor scan falls within their respective windows. In response, they produce respective OWN1, OWN2, . . . . , and OWN63 signals to indicate the results of the determination. The OWN0, OWNl . . . , and OWN63 signals are applied to a priority circuit 76. The priority determination. The OWN0, OWN1 . . ., and OWN63 signals as well as CC0, CC1, . . . , and CC63 signals from the several buffer and cursor registers, and it generates BUFSEL and CC signals having the values of the SELn and CCn signals, respectively, associated with the highest-priority window whose OWNn signal was asserted. That is, it determines the highest-priority window within which the current scan position falls, and it indicates which of the two buffers 32 and 34 the highest-priority window is to use and whether that window will permit display of a cursor. Typically, the priority signal also generates both a six-bit WINDOW signal to identify the highest-priority window within which the scan position falls and a one-bit VALID signal to indicate whether the current scan address falls within at least one of the windows.

There are actually four priority circuits 76, one corresponding to each of the four pixels whose data are simultaneously processed, and the four resultant BUFSEL signals are the four signals that the window/cursor circuit 46 applies to the multiplexers 42*a–d*.

Figure 5:
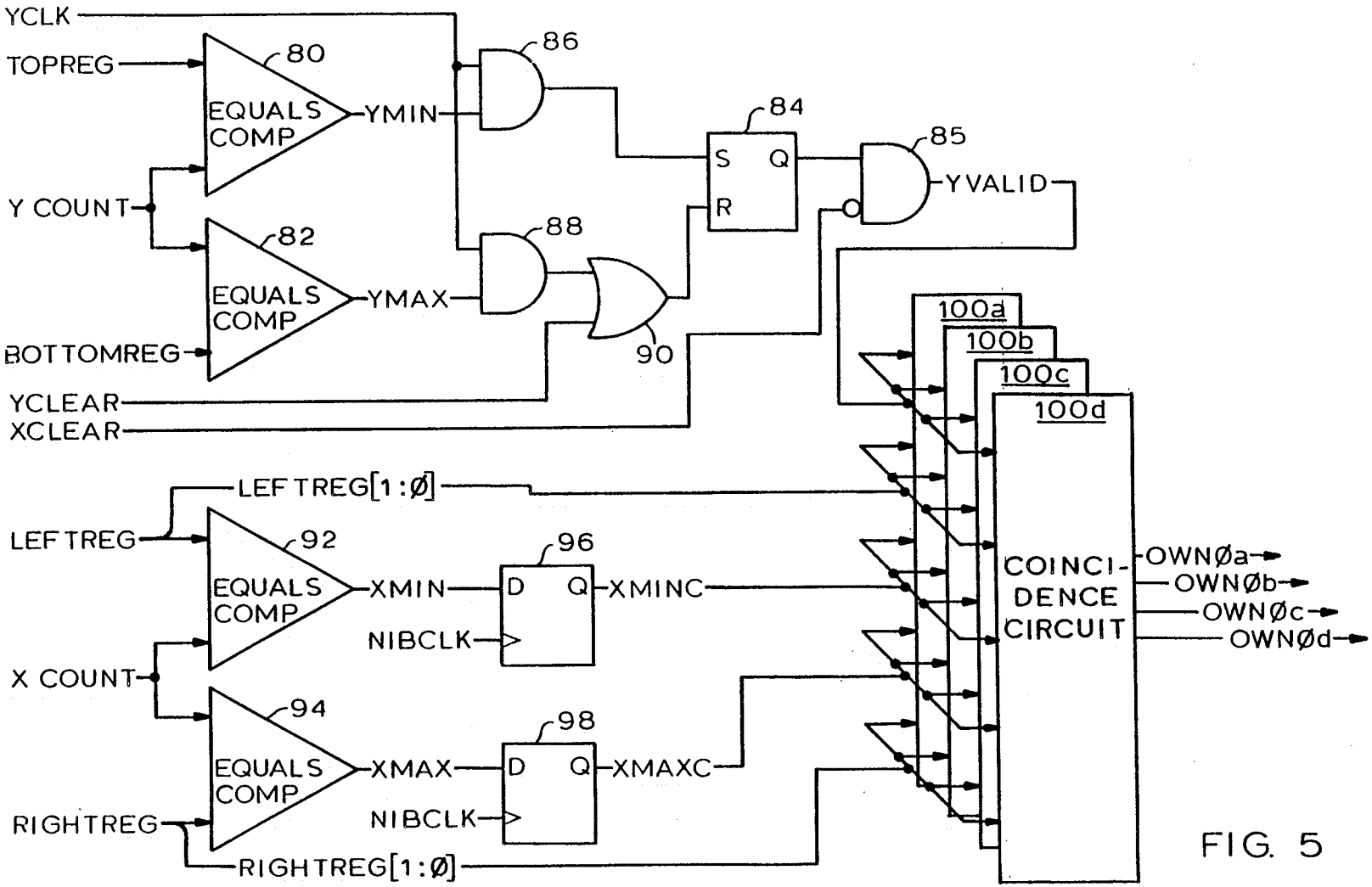
FIG. 5 is a block diagram of the window-detection circuit included in the selection-signal source.
Figure 6:
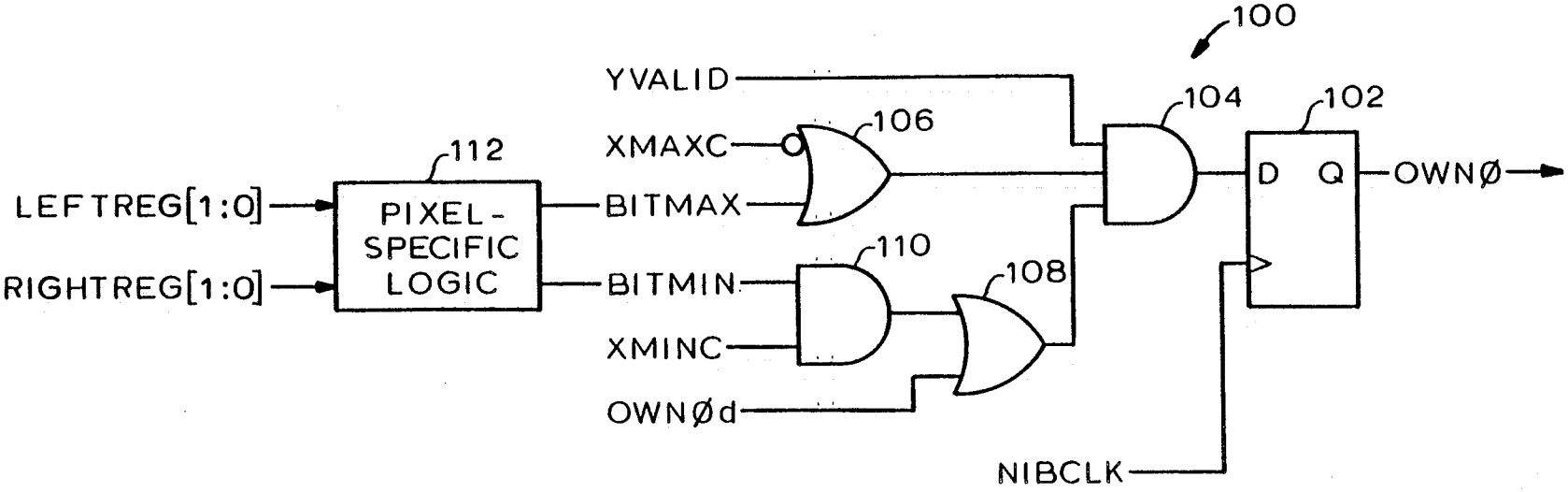
FIG. 6 is a logic diagram of a coincidence circuit included in the window-detection circuit.

FIGS. 5 and 6 together depict the window detector 56 of FIG. 4 in greater detail. Two equals-type comparators 80 and 82 receive the outputs from the respective top and bottom registers 62 and 64 of FIG. 4 and compare them with the output of the Y counter 74 of FIG. 4. If its two inputs are equal, comparator 80 produces a YMIN signal with a value of one; otherwise YMIN is zero. Similarly, comparator 82 makes its output YMAX equal to one when its two inputs are the same and makes YMAX zero otherwise. That is, YMIN is one when the scan goes through the top boundary of the window, while YMAX is one when the scan goes through the bottom boundary.

YMIN and YMAX are used respectively to set and reset a flip-flop 84 when the scan passes through the top and bottom boundaries of the window whose boundaries are defined by registers 62, 64, 66, and 68. The purpose of flip-flop 84 is to generate a signal that, during horizontal scans, is forwarded by an AND gate 85 to generate YVALID, which indicates that the scan is between the top and bottom window boundaries. However, the Y counter output is not always valid; sometimes its value is in transition. Therefore, YMIN and YMAX are not always valid. To prevent flip-flop 84 from being set or reset erroneously, therefore, AND gates 86 and 88 are interposed in the YMIN and YMAX lines so as to forward the YMIN and YMAX values only when a signal YCLK has a value of one. The timing circuitry 56 generates a one-valued YCLK signal only at a point in time, which occurs during the horizontal blanking period of the monitor, at which the Y counter output is known to be valid. The resulting pulses from gates 86 and 88 respectively set and reset flip-flop 84.

To insure that flip-flop 84 indicates that the scan is no longer within a window when a new scan begins, the timing circuit 36 generates a YCLEAR signal during vertical blanking and applies it to an OR gate 90, which also receives the output of gate 88, so that flip-flop 84 can be reset not only by the gated YMAX signal but also by the YCLEAR signal.

The part of the circuit of FIG. 5 described so far determines whether the scan is within the vertical boundaries of a window. If the illustrated embodiment did not process four pixels at at time, a similar circuit could also be used to determine whether the scan is within the horizontal boundaries of a window, and the two results could simply be ANDed together to generate an indication of whether the current pixel is located within the window associated with window detector 56. Since four pixels are being processed simultaneously, however, window detector 56 determines simultaneously whether four adjacent pixels fall within a window, and some pixels within a four-pixel group can fall within a given window while the others do not; that is, the window detector 56 must make a separate determination for each of the four pixels. For this reason, the remainder of the circuitry depicted in FIGS. 5 and 6, with details in FIGS. 7 and 8, is somewhat more elaborate than would otherwise be necessary.

Two further equals comparators 92 and 94 receive the outputs of the left and right registers 66 and 68, respectively, and compare them with the output of the X counter so as to generate XMIN and XMAX, which are true when the scan position is at the left and right boundaries, respectively. To obtain values that are generated only while the X counter output is valid, the XMAX and XMIN signals are applied to corresponding flip-flops 96 and 98, which are clocked by a NIBCLK (nibble clock) signal, which the timing generator 36 generates every nibble interval. i.e., every four pixel times. The resulting outputs of flip-flops 96 and 98 are XMINC and XMAXC signals, which indicate whether the left and right boundaries, respectively, fall within the currently processed four-pixel group.

As was mentioned above, the output of the X counter does not give the complete X address; it lacks the two least-significant bits. For this reason, the two least-significant bits of the left-register and right-register outputs are not applied to comparators 92 and 94. The XMINC and XMAXC signals thus indicate only whether the boundary falls within a four-pixel group; they do not indicate where within that group the boundary falls. In order to make that determination, four coincidence circuits 100*a–d*, one for each of the four pixels, processes the two least-significant bits of the left- and right-register outputs. The four coincidence circuits produce respective output signals OWN0*a-d*, which indicate whether the respective pixels within the four-pixel group fall within the window associated with window detector 56.

FIG. 6 depicts one of the coincidence circuits. As FIG. 6 indicates, each coincidence circuit 100 includes a D-type flip-flop 102 whose output is one of the OWN0 signals. The value of OWN0 is determined by the signal at the D input port of flip-flop 102 when that flip-flop is clocked by the NIBCLK signal.

As was indicated above, a YVALID signal whose value is one indicates that the scan is between the Y boundaries of the window, so flip-flop 102 should be set only if the YVALID value is one. Accordingly, an AND gate 104 controlled by YVALID is provided at the D input port of flip-flop 102 to cause that input to be zero—and thus the OWN0 signal to be zero on the next clock—whenever the Y scan location does not fall between the upper and lower window boundaries.

If the Y scan location does fall between the Y window boundaries, on the other hand, the value of the OWN0 signal is controlled by the outputs of gate 106 and 108, which together determine whether the scan location is between the horizontal boundaries. Gate 108 has a value of one whenever XMAX is not one--i.e., whenever the right boundary does not fall within the four-pixel group whose data are currently being processed. Therefore, it is gate 108 that usually determines whether gate 104 will cause flip-flop 102 to set OWN0 equal to one and thereby indicate that the current scan location is within the window.

Gate 108 has an output of one under either of two circumstances. One of those circumstances is that OWN0d is one; i.e., if the rightmost pixel of the previous four-pixel group was in the window, then gate 108 will cause the OWN0 signal generated by its one of the four coincidence circuits 100*a–d* to indicate that its associated pixel in/the next group is in the window, too—so long as XMAX does not indicate that the right boundary falls in the next group.

If the rightmost pixel of the previous prixel group did not fall within the window, on the other hand, the output gate 108 may still have a value of one if XMINC indicates that the left window boundary falls in the next four-pixel group. Whether the gate 108 output does have a value of one is determined by a BITMIN signal, which controls an AND gate 110 that gates XMINC to an input port of gate 108. The BITMINC signal, in turn, is generated by pixel-specific logic 112, which processes the two least-significant bits of the right and left boundary addresses to determine whether the specific pixel with which it is associated falls within the window when the left boundary falls within a four-pixel group. The rightmost pixel within a four-pixel group always falls within the window when the left boundary falls within a four-pixel group, so OWN0d assumes a value of one, and, through gates 104 and 108, it effectively latches flip-flop 102 in all of the coincidence circuits 100*a–d* so that OWN0*a–d* all remain at a value of one. Flip-flop 102 remains latched for all subsequent four-pixel groups until XMAX indicates that the right boundary falls within the next four-pixel group.

When the scan reaches the right boundary, however, the XMAX signal becomes one, causing the output of OR gate 106 to become zero unless the pixel-specific circuit 112 indicates, by a BITMAX signal equal to one, that the pixel represented by the specific one of the coincidence circuits 100*a–d* remains within the window even though the rightmost window boundary falls within the four-pixel group. BITMAX is similar to BITMIN and is generated, as will be described below in connection with FIGS. 7A-D, by processing the two least-significant bits of the right-boundary address.

When the four-pixel group reaches the right boundary, therefore, the respective BITMAX signals determine whether the OWN0*a–d* signals indicate that their respective pixels fall within the window; some may while others may not. In the case of the rightmost pixel, however, the presence of the right boundary in the group means that at least the rightmost pixel must be outside the window. Therefore, OWN0d will be zero even if all of the other OWN0 signals are one. Accordingly, on the subsequent group of four pixels, OWN0d will be zero and thereby cause the output of OR gate 108 to have a value of zero, and this will disable gate 104 and cause flip-flop 102 to have a zero output for all of the coincidence circuits 100*a–d*. OWN0a-d will therefore remain at a value of zero until the next horizontal scan, when XMINC again indicates that the left window boundary has been reached.

If, due to some error, XMAX fails to assume a value of one during a horizontal scan, the OWN0 signal generated by flip-flop 102 will still return to a zero output during horizontal retrace; the timing circuit generates an XCLEAR signal during this time and applies it to gate 85 of FIG. 5, thereby causing YVALID temporarily to assume a zero value and disable gate 104.

Figure 7A:
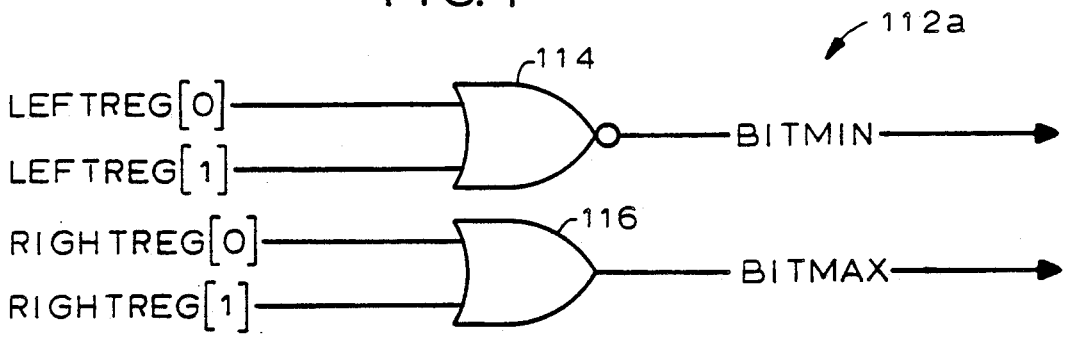
FIGS. 7A–D are logic diagrams of pixel-specific logic used in four versions of the coincidence circuit.

FIGS. 7A–D depict the four pixel-specific circuits 112, which indicate, when a left or right boundary is encountered, whether specific pixels fall within the window. FIG. 7A is the pixel-specific circuit for the leftmost pixel in the four-pixel group. In a nibble interval in which the left window boundary falls within the four-pixel group, the leftmost pixel falls within the window only if the two least-significant bits of the boundary address are both zero. Therefore, pixel-specific circuit 112*a* includes a gate 114 that receives LEFTREG[1:0]and generates a high BITMIN signal only if LEFTREG[1:0]has a value of 00.

On the other hand, when the right boundary falls within the four-pixel group, the leftmost pixel falls in the window during that nibble interval unless the two least-significant bits of the window's right boundary position are both 0. For this reason, the gate 116 that generates BITMAX always generates a high BITMAX signal unless RIGHTREG[1:0]is 00.

Figure 7B:
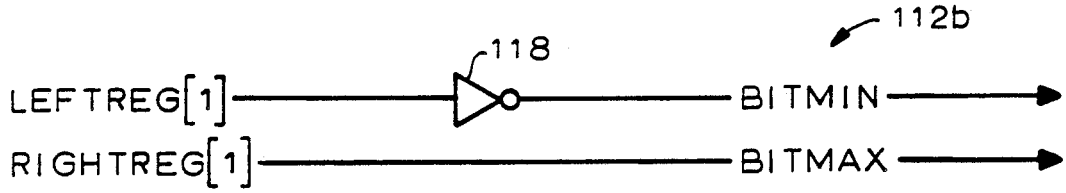

FIG. 7B depicts the pixel-specific logic 112*b* used for the second pixel from the left. When the left window boundary falls within the four-pixel group, this pixel falls outside the window for LEFTREG[1:0]values of 00 and 01. Accordingly, circuit 112*b* generates BITMIN by merely inverting LEFTREG[1]. The circuit for generating BITMAX is even simpler; BITMAX has the same value as RIGHTREG[1].

Figure 7C:
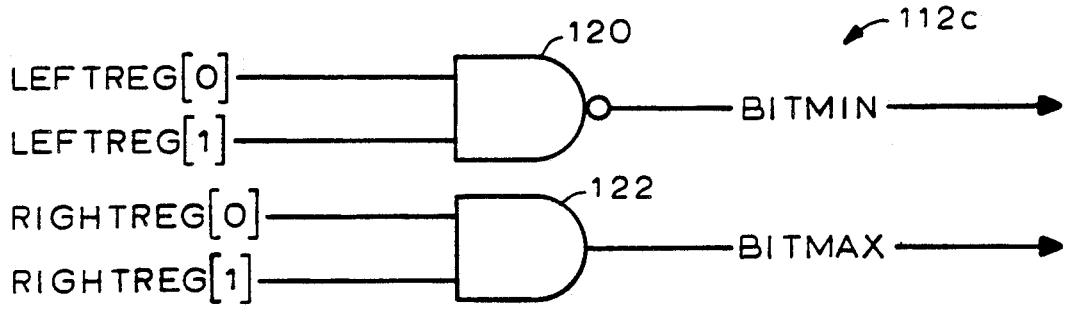
Figure 7D:
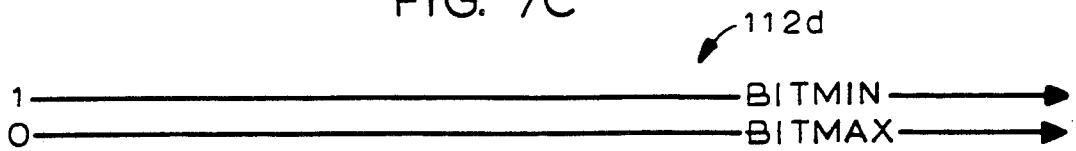

FIG. 7C depicts the pixel-specific logic 112*c* for the third pixel from the left. When the left window boundary falls within the four-pixel group, this pixel always falls within the window unless the two least-significant bits of the left-boundary position are both ones. For this reason, gate 120 generates a BITMIN signal that has a value of one unless LEFTREG[1:0]has a value of 11. Similarly, gate 122 generates a low BITMAX signal unless XMAX0 and XMAXl are both one.

For the rightmost pixel, the values of BITMIN and BITMAX do not depend on the boundary addresses, so coincidence circuit 100*d* for the rightmost pixel does not actually need to include gates 106 and 110. If they were included, however, the BITMIN and BITMAX signals would be constant one and zero values, as FIG. 7D indicates.

Figure 8A:
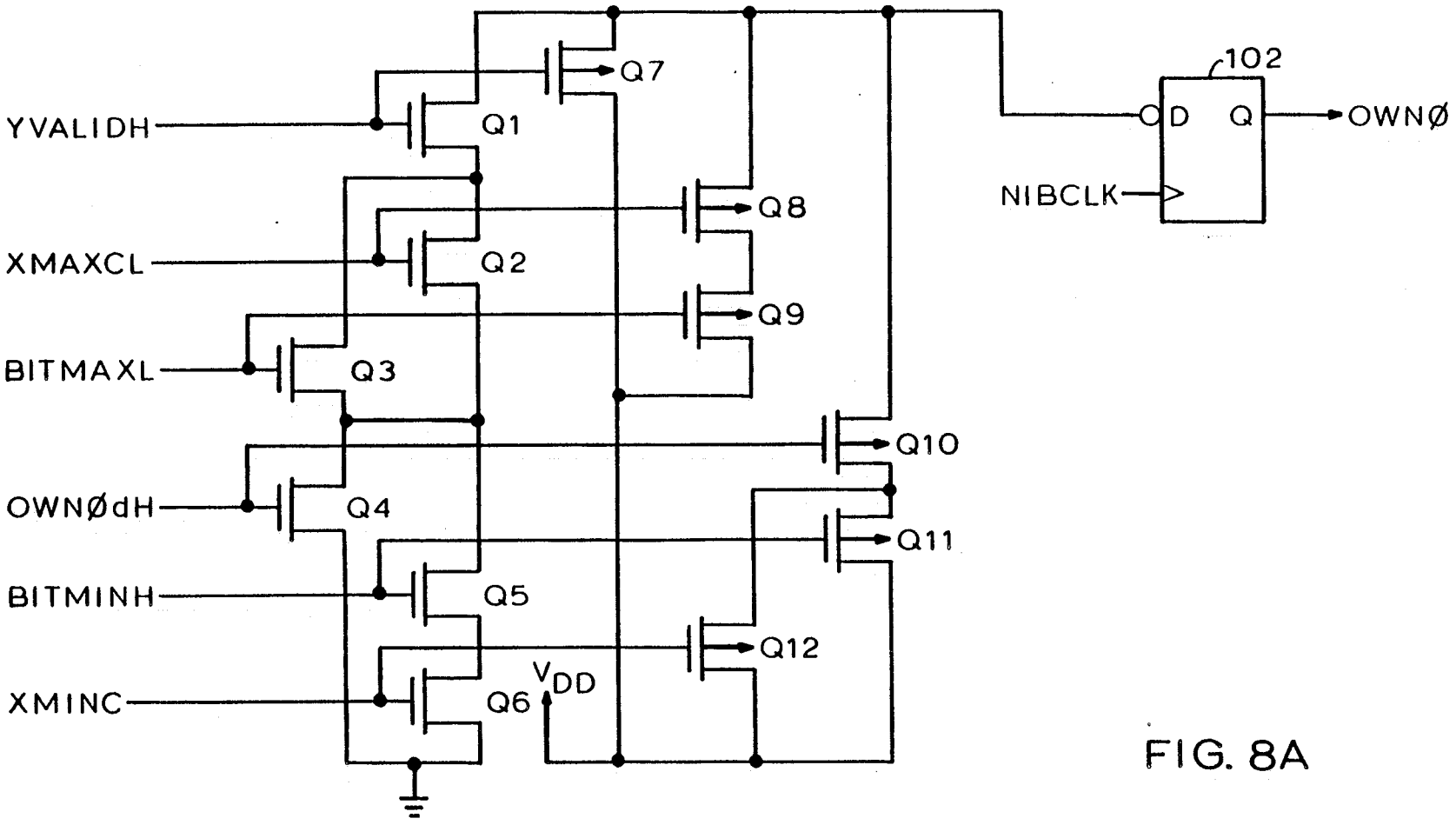
FIGS. 8A and 8B are schematic diagrams of gate circuitry employed in the window-detection circuitry.

Although FIG. 6 depicts a number of separate gates 104, 108, 110, and 112, a specific embodiment of this invention actually provides the logic features of that gate combination in a single complex gate depicted in FIG. 8. In FIG. 8, all of the signals have a suffix "H" or "L" to indicate the level of their true, or one states. As that drawing indicates, high values of all the signals except for XMAXC, BITMAX, and the D input of flip-flop 102 represent the true state in the logic representation of FIG. 6, while low values of XMAXC, BITMAX, and the D input of flip-flop 102 represent their true states. Transistors Q1, Q2, Q3, Q4, Q5, and Q6 are n-channel field-effect transistors, which conduct when they receive high signals at their gates, while Q7, Q8, Q9, Q10, Q11, and Q12 are p-channel field-effect transistors, which conduct in response to low signals at their gates. A low (true) value results when the n-channel transitors provide a path to ground, and a high (false) value results when the p-channel transistors provide a path to $V_{DD}$. With these facts in mind, it is apparent that circuit of FIG. 8A implements the logic of gates 104, 108, 110, and 112 of FIG. 6 for the first three pixels and could be used for the rightmost pixel, too.

Figure 8B:
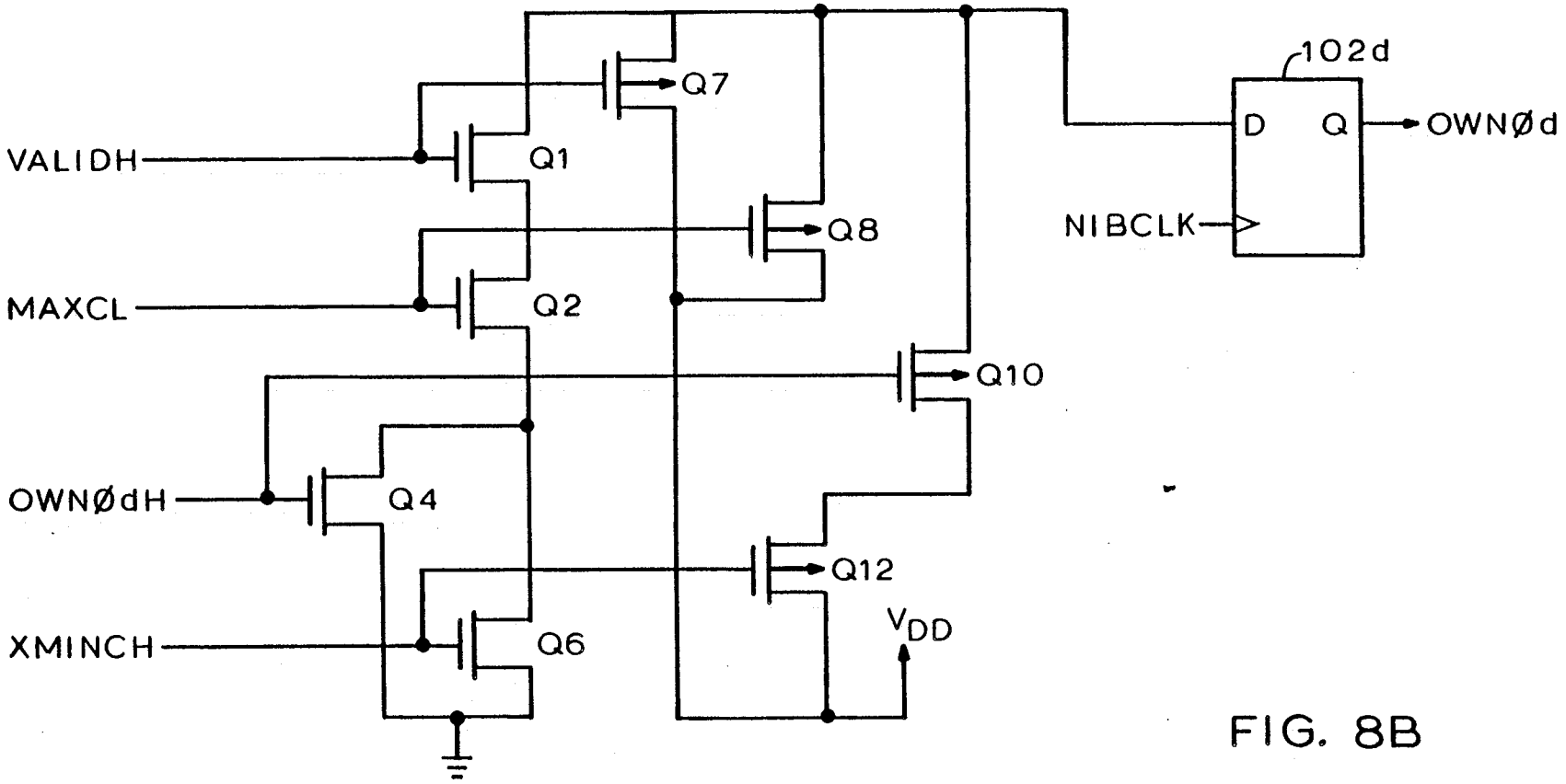

For the rightmost pixel, however, we have chosen to eliminate gates 106 and 110 because the BITMIN and BITMAX signals are unnecessary. FIG. 8B depicts the resulting circuit, which is the same as that of FIG. 8A except that it omits Q3, Q5, Q9, and Q11. This is equivalent to omitting gates 106 and 110 from FIG. 6.

Figure 9:
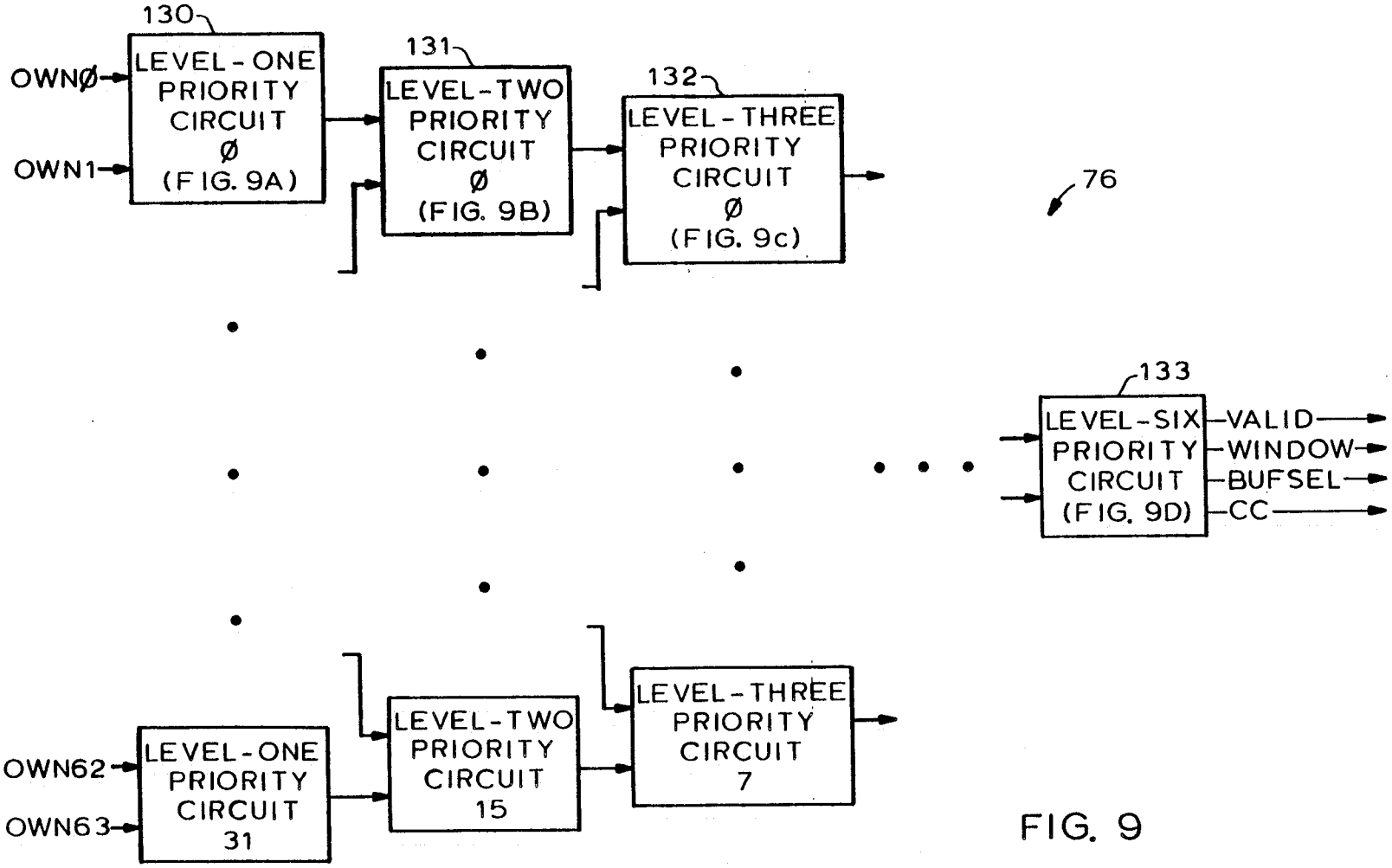
FIG. 9 is a block diagram of the priority circuit employed in selection-signal source.

FIG. 9 depicts the priority circuit 76 of FIG. 4 in more detail. The priority circuit 76 consists of a tree of individual priority circuits. The tree begins at its lowest level with thirty-two level-one priority circuits 130. Each of these level-one priority circuits receives inputs, as will be described in more detail in connection with FIG. 9A, from a pair of window detectors. Each level-one priority circuit 130 processes these inputs to determine whether the current scan location falls within either of the windows whose detector outputs it receives, and, if the scan location falls within both windows, it identifies the higher-priority window.

The outputs from pairs of level-one priority circuits are applied to level-two priority circuits 131, of which there are sixteen. In a similar manner, the level-two priority circuits 131 arbitrate between their inputs and generate outputs identifying the winning windows. The level-two priority circuits 131 will be described in more detail in connection with FIG. 9B.

Similarly, the outputs of the level-two priority circuits are applied in pairs to level-three priority circuits 132, of which there are eight. This progression continues to a single level-six priority circuit 133, which generates as its output the identity of the highest-priority window in which the scan is currently located. Of particular importance to the present invention is that the priority circuits also identify the buffer selected for the window that has won the priority determination.

Figure 9B:
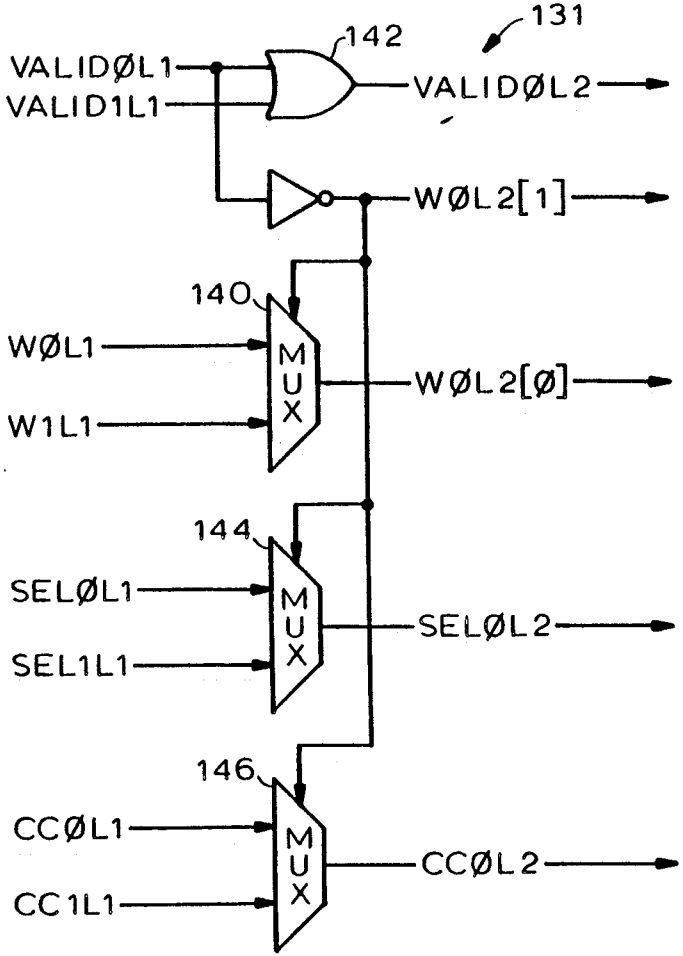
FIGS. 9A–D logic diagrams of individual stages in the priority circuit of FIG. 9.
Figure 9A:
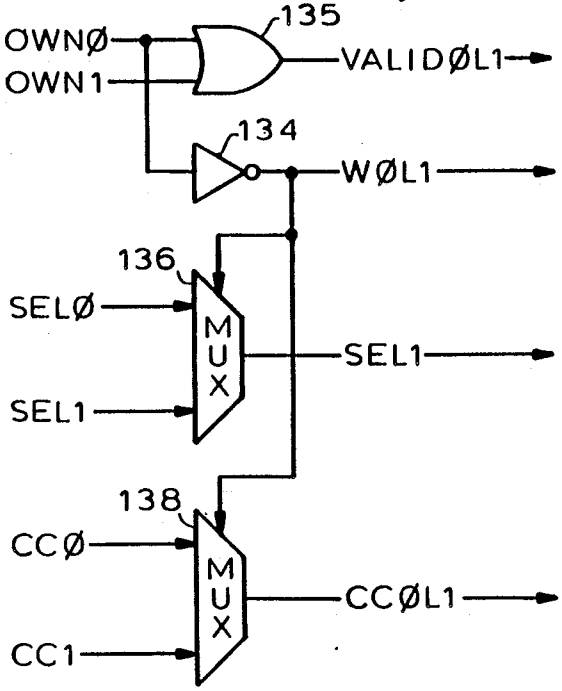

FIG. 9A depicts the first level-one priority circuit 130. As was stated above, there are thirty-two such circuits, and they are identified with index numbers 0–31. Each such circuit receives a pair of OWNn signals, one from each of two successive window detectors. In the case of level-one priority circuit 0 depicted in FIG. 9A, those two signals are OWN0 and OWNl. In the case of level-one priority circuit 1, the two signals would be OWN2 and OWN3, and for level-one priority circuit n, the two signals would be OWN2n and OWN2n+1. The lower-indexed window is the higher-priority window, and it is the one that wins the priority determination as between it and a lower-indexed window if both of them contain the current scan location.

The priority circuit 130 generates an output W0L1 (Window-identification signal from the 0th priority circuit at Level 1) to specify the higher-priority window containing the scan location. For this purpose, circuit 130 includes an inverter 134, which receives the OWN0 signal and inverts it to produce the W0L1 signal. If OWN0 is one, the winning window is window 0, so zero is the value of window-identification signal W0L1, which thereby indicates that, as between window 0 and window 1, window 0 is the higher-priority window that contains the current scan location. If OWN0 is zero but OWN1 is one, WOL1 has a value of one.

If the current scan location is in neither of those two windows, both OWN0 and OWN1 will be zero, so W0L1 will erroneously assume a value of 1. To indicate to subsequent circuitry that this value should be ignored, circuit 130 provides an OR gate 135 to generate a high VALID0L1 signal, which is zero when both OWN0 and OWN1 are low but one in all other circumstances.

In addition to identifying the winning window, the priority circuit 130 forwards the buffer selection of the winning circuit. For this purpose, circuit 130 includes a multiplexer 136 that receives the SEL0 and SEL1 signals, which are the outputs of buffer registers 70 and 137 of FIG. 4. If window 0 is the winning window, multiplexer 136 forwards the SEL0 signal as SEL0L1. It forwards the SEL1 signal as SEL0L1 if window 1 has won.

The priority circuit 130 also receives cursor signals CC0 and CC1, which indicate whether the cursor will be allowed to be displayed in window 0 and window 1, respectively. Circuit 130 includes another multiplexer 138, which operates in a manner similar to that in which multiplexer 136 operates and thereby generates a CC0L1 signal to indicate whether the winning window can contain a cursor.

Circuit 130 applies all of its output signals to a level-two priority circuit 131 bearing index number zero, which also receives similar signals from level-one priority circuit 1 and processes these signals in a manner similar to that in which the level-one priority circuits process the window-detector. The level-two priority circuits thereby determine, as between pairs of the winning windows in level one, which windows will win at level two.

FIG. 9B depicts circuit 131 in detail. The determination of which of the two winning windows from level one will win at level two is made simply by the value of the level-one VALID signal from the higher-priority pair. That is, if VALID0L1 has a value of one, then there is a valid winning window from the higher-priority pair, so the window from that pair wins. Accordingly, a multiplexer 140, which receives the window-identifying signals W0L1 and W1L1 from the two level one priority circuits, forwards as its W0L2[0]signal the level-one window-identifying signal selected by VA- LID0L1. If the higher-priority pair does not includes a window that contains the current scan location, on the other hand, multiplexer 140 forwards the W0L1 signal instead so that the level-two winning-window signal W0L2[0] identifies the window from the lower-priority pair that won at level one.

As was the case with the output of multiplexer 136 of FIG. 9A, the output of multiplexer 140 is erroneous if neither of its inputs is valid. To detect this condition, an OR gate 142 receives the VALID0L1 and VALID1L1 signals and generates a VALID0L2 signal that has a value of zero if both inputs are zero, indicating that neither input is valid. In that situation, subsequent circuitry will "ignore" the other outputs of level-two priority circuit 131 in the manner in which level-two priority circuit 131 does in response to zero values of VALID0L1 and VALID1L1.

The level-two priority circuit 132 also includes two further multiplexers 144 and 146, which operate in a manner similar to that in which multiplexers 136 and 138 do so as to forward as outputs SEL0L2 and CC0L2 the buffer-select and cursor-control information associated with the winning window.

As was explained above, FIG. 9B depicts the level-two priority circuit identified by index number 0. That circuit receives inputs from the level-one circuits that bear index numbers 0 and 1: hence the 0 and 1 indices in the names of its input signals. There are fifteen other level-two priority circuits, and they bear indices 1–15. The level-two circuit bearing index n receives its inputs from the level-one circuits bearing indices 2n and 2n+1.

The window-identifying signal W0L1 from FIG. 9A consists of only one bit; its purpose is to designate which of two windows is the winning window. In contrast, the identifying signal W0L2 from FIG. 9B must specify one of four windows, so it requires two bits. The less-significant bit is the window-identifying bit forwarded by multiplexer 140 from circuit 130 in FIG. 9A. The more-significant bit is the inverted value of VALID0L1; if the higher-priority (lower-index) window pair included a window that contained the scan location, then the more-significant bit should be zero. Otherwise, it should be one. (Again, this information may be erroneous if neither of the window pairs includes a window containing the scan position, but the VALID signals are used to take care of this possibility.) Thus, the two-bit window-identifying signal consists of W0L2[1], which is the inverted value of VALID0L1, and W0L2[0], which is the output of multiplexer 140.

Figure 9C:
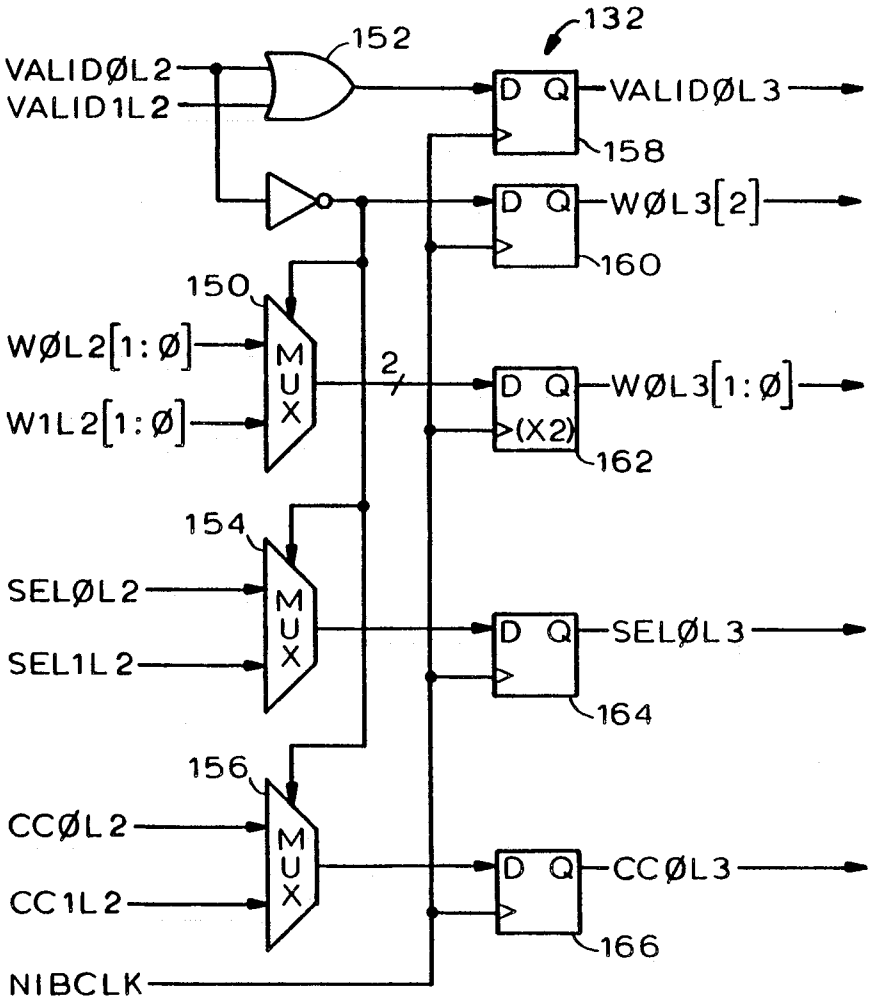

FIG. 9C depicts a level-three priority circuit 132. Circuit 132 operates in a manner similar to that in which circuit 131 of FIG. 9B operates, with elements 150, 152, 154, and 156 corresponding in function to elements 140, 142, 144, and 146 of FIG. 9B. The only difference between corresponding elements is that multiplexer 150 has two two-bit inputs rather than two one-bit inputs and so has a two-bit output rather than a one-bit output. The major difference between the circuits of FIGS. 9C and 9B is that FIG. 9C includes latches 158, 160, 162, 164, and 166. These latches are clocked once each nibble interval by the NIBCLK signal. In our particular implementation, it was felt that provision of such latches would be desirable to reduce the effect of propagation-delay differences among the parallel signal paths. For this purpose, such latches are included in the level-three circuits and in the level-six circuits but are not provided for the other levels. Clearly, such synchronization can be provided at one or more other levels or, in appropriate circumstances, omitted entirely.

Figure 9D:
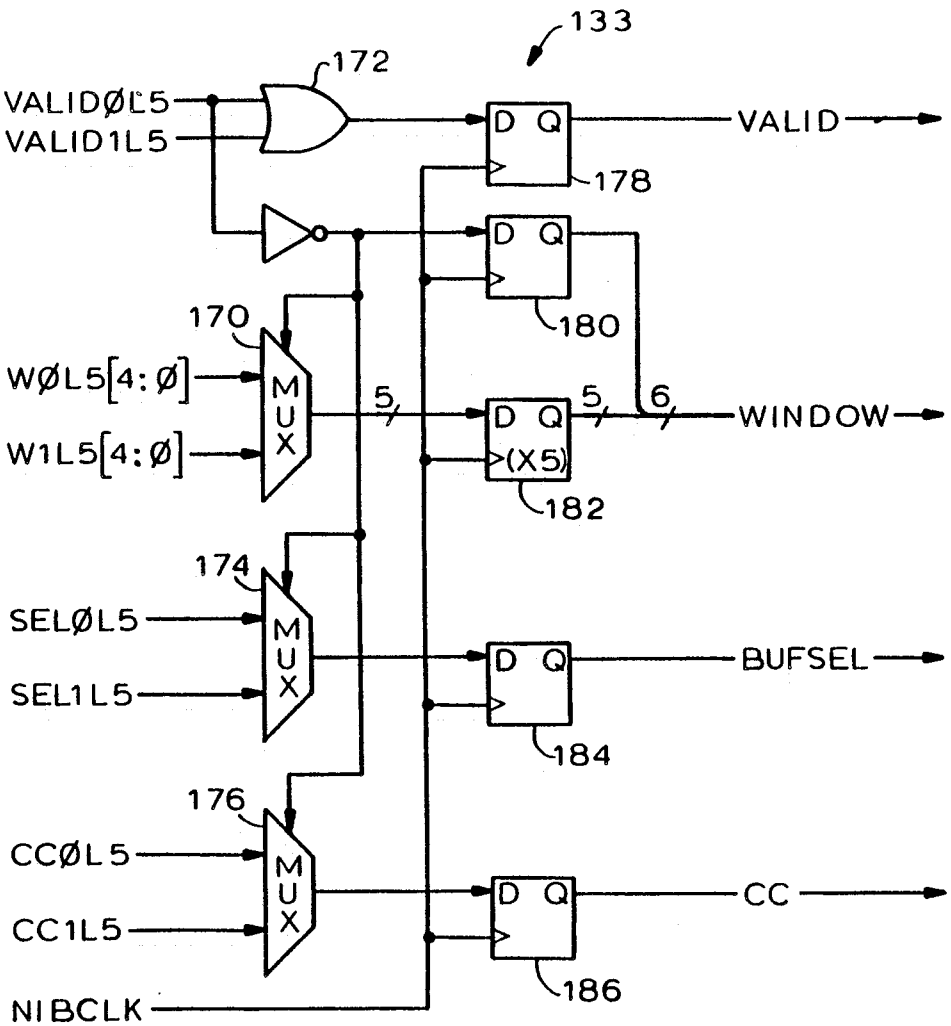

This tree organization continues through fourth, fifth, and sixth-level priority circuits, which are similar to those of FIGS. 9B and 9C with the exception that each level provides an additional window-identifying bit. FIG. 9D depicts the sixth-level priority circuit 134. Since there are sixty-four window-detector circuits, the sixth level is the last level ($2^6=64$), and there is only one six-level priority circuit per pixel. (Our implementation processes four pixels simultaneously, so the circuitry of FIG. 9 is replicated four times, one for each of the four pixels simultaneously processed.)

In FIG. 9D, elements 170, 172, 174, 176, 178, 180, 182, 184, and 186 perform the same functions as do elements 150, 152, 154, 156, 158, 160, 162, 164, and 166 of FIG. 9C with the exception that the circuit of FIG. 9D generates three additional window-identifying bits to produce the six-bit WINDOW signal shown in FIG. 4 instead of the three-bit W0L3 signal produced by the circuit of FIG. 9C. FIG. 9D also shows the generation of the VALID, BUFSEL, and CC signals shown in FIG. 4.

The CC signal is used within the window/cursor circuit 46 to control the generation of a CURSOR signal, which the window/cursor circuit 46 applies to a parallel-to-serial converter 188 (FIG. 3) so as to generate a two-bit control signal for multiplexers 49*a–c*. If the CC signal has a value of zero, indicating that the window should not contain a cursor, the value of the CURSOR signal will be 00, indicating that the multiplexers 49*a–c* should draw their inputs from the digital-to-analog converters 28*a–c*. On the other hand, if the CC signal indicates that the window should contain a cursor, circuitry within the window/cursor circuit 26 would generate a CURSOR signal that assumes values that select among the outputs of digital-to-analog converters 28*a–c* and three constant values $C_1$, $C_2$, and $C_3$ in such a manner as to form a cursor of the desired shape.

In operation, each of several applications that run in the host computer 14 loads values into the registers in FIG. 4 associated with that application's window so as to indicate the boundary positions of its windows and specify the frame buffer from which image data for that window are to be drawn. As the pixel-drawing engine 40 operates the frame buffer, the window detectors 56, 58, and 60 automatically determine which windows contain the current pixel, and the priority circuit 76 selects from among these windows the one that has the highest priority. It then supplies to the multiplexer circuit 42 a signal that represents the contents of the buffer register associated with the winning window, and the monitor is thereby controlled by the contents of the proper frame buffer.

We have described the invention by reference to a specific embodiment, which we feel has significant benefits. In this embodiment, each hardware application is required only to specify to the hardware the priority of the window that it uses and the frame buffer from which the image in that window is intended to be drawn. The proper switching between buffers during the scan is then implemented automatically by the hardware, which itself computes, for each pixel, the window that that pixel is to be used to display and the buffer from which data for that pixel are to be drawn. However, the broader teachings of the present invention do not require the specific features described in the foregoing specification. The major benefit of the present invention—i.e., avoidance of the need to synchronize separate applications—does not require that the hardware level determine which pixels will be used to display which windows. Indeed, a software server can be assigned the task of determining which pixels are controlled by which frame buffers, and the software can store this result in the hardware to control the multiplexing between frame buffers.

Rather than simply write into the hardware the boundaries and priorities of the several windows, for instance, the software could itself determine the distance to the next location at which the multiplexers 42 are to be switched and could load hardware counters provided for that purpose. Thus, the broad teachings of the present invention can be embodied in a wide range of systems and still afford the principal benefits of the invention. Is thus apparent the present invention constitutes a significant advance in the art.

We claim:

1. A display system comprising:

A. an image generator, including a display screen and adapted to receive an image-data signal representing image data, for scanning locations on the screen in an ordered manner in successive scan frames and displaying in the scanned screen locations pixels having pixel values determined by the image-data signal received concurrently with the scanning of the screen locations;

B. a plurality of frame buffers, each frame buffer containing image data representing a respective image and being operable to generate a frame-buffer output representing the image data;

C. timing circuitry for operating the image generator and frame buffers in synchronism with each other;

D. a selection-signal source for generating a selection signal having a plurality of states, each state designating a respective frame buffer, the selection-signal source including means for changing the selection-signal state in the midst of a scan frame, the selection-signal source comprising:

i. a plurality of source-selection registers, each source-selection register being associated with a different one of a plurality of windows, for generating source-selection signals that designate the frame buffers from which data to be displayed in their associated windows are to be drawn;

ii. counter means for generating address signals that represent the addresses of the pixels whose data are currently being represented by the image-data signal;

iii. boundary registers, containing boundary data representing the locations of boundaries of the windows that can overlap so that a given scan location can fall into more than one window, for generating boundary signals that represent the boundary data;

iv. comparison means, connected to receive the address and boundary signals, for comparing the address and boundary signals to determine whether the current scan location falls in any of the windows and generating ownership signals identifying all such windows simultaneously; and v. a selection-signal generator including priority means for assigning a predetermined priority to the windows and responsive to the ownership and source-selection signals to generate as the selection signal a signal designating the frame buffer designated by the source-selection register associated with the window that has the highest priority among those windows identified by ownership signals; and E. a multiplexer, connected for reception of the frame-buffer outputs and the selection signal, for producing and applying to the image generator as the image-data signal a multiplexer output determined by the frame-buffer output of the frame buffer that the selection signal designates.

2. A display system as defined in claim 1 further including validity means responsive to the comparison means to generate a validity signal that indicates whether, on the one hand, the current scan location falls in at least one of the windows or, on the other hand, it falls in none of the windows.

3. A display system comprising:

A. an image generator, including a display screen and adapted to receive an image-data signal representing image data, for scanning locations on the screen in an ordered manner in successive scan frames and displaying in the scanned screen locations pixels having pixel values determined by the image-data signal received concurrently with the scanning of the screen locations;

B. a plurality of frame buffers, each frame buffer containing image data representing a respective image and being operable to generate a frame-buffer output representing the image data;

C. timing circuitry for operating the image generator and frame buffers in synchronism with each other;

D. a selection-signal source for generating a selection signal having a plurality of states, each state designating a respective frame buffer, the selectionsignal source including means for changing the selection-signal state in the midst of a scan frame, the selection-signal source comprising:

i. a plurality of source-selection registers, each source-selection register being associated with a different one of a plurality of windows, for E. generating source-selection signals that designate the image-data sources from which data to be displayed in their associated windows are to be drawn;

ii. counter means for generating address signals that represent the addresses of the pixels whose data are currently being represented by the image-data signal;

iii. read/write boundary registers, containing boundary data representing the locations of boundaries of the windows, which boundary data can be changed to change the positions of the windows on the display, for generating boundary signals that represent the boundary data;

iv. comparison means, connected to receive the address and boundary signals, for comparing the address and boundary signals to determine whether the current scan location falls in any of the windows and generating an ownership signal identifying such a window; and v. a selection-signal generator responsive to the ownership and sourceselection signals to generate as the selection signal a signal designating the image-data source designated by the source selection register associated with the window identified by an ownership signal; and E. a multiplexer, connected for reception of the framebuffer outputs and the selection signal, for producing and applying to the image generator as the image-data signal a multiplexer output determined by the framebuffer output of the frame buffer that the selection signal designates.

4. A display system comprising:

A. an image generator, including a display screen and adapted to receive an image-data signal representing image data, for scanning locations on the screen in an ordered manner in successive scan frames and displaying in the scanned screen locations pixels having pixel values determined by the image-data signal received concurrently with the scanning of the screen locations;

B. a plurality of frame buffers, each frame buffer containing, in buffer locations corresponding to the screen locations, image data representing a respective image and being operable to scan its buffer locations to generate a frame-buffer output representing the image data;

C. timing circuitry for operating the frame buffers to scan their respective buffer locations in synchronism with the scanning of the corresponding screen locations;

D. a selection-signal source for generating a selection signal having a plurality of states, each state designating a different respective frame buffer, the selection-signal source including means for changing the selection-signal state while the image data are being displayed; and E. a multiplexer, connected for reception of the framebuffer outputs and the selection signal, for producing and applying to the image generator as the image-data signal a multiplexer output determined by the framebuffer output of the frame buffer that the selection signal designates.

5. A display system as defined in claim 4 wherein the selection-signal source includes:

A. a plurality of source-selection registers, each source-selection register being associated with a different one of a plurality of windows, for generating source-selection signals that designate the frame buffers from which data to be displayed in their associated windows are to be drawn;

B. counter means for generating address signals that represent the addresses of the pixels whose data are currently being represented by the image-data signal;

C. boundary registers, containing boundary data representing the locations of boundaries of the windows, for generating boundary signals that represent the boundary data;

D. comparison means, connected to receive the address and boundary signals, for comparing the address and boundary signals to determine whether the current scan location falls in any of the windows and generating an ownership signal identifying such a window; and E. a selection-signal generator responsive to the ownership and source-selection signals to generate as the selection signal a signal designating the frame buffer designated by the source-selection register associated with the window identified by an ownership signal.

6. A display system as defined in claim 5 further including validity means responsive to he comparison means to generate a validity signal that indicates whether, on the one hand, the current scan location falls in at least one of the windows or, on the other hand, it falls in none of the windows.

7. A display system comprising:

A. an image generator, including a display screen and adapted to receive an image-data signal representing image data, for scanning locations on the screen in an ordered manner in successive scan frames and displaying in the scanned screen locations pixels having pixel values determined by the image-data signal received concurrently with the scanning of the screen locations;

B. a plurality of image-data sources, each image-data source comprising means for generating an image-datasource signal containing image data representing pixels in a different respective image concurrently with the scanning by the image generator of locations corresponding to the locations of the represented pixels in the respective image;

C. a selection-signal source for generating a selection signal having a plurality of states, each state designating a respective image-data source, the selection-signal source including means for changing the selection-signal state in the midst of a scan frame, the selection-signal source comprising:

i. a plurality of source-selection registers, each source-selection register being associated with a different one of a plurality of windows, for generating source-selection signals that designate the image-data sources from which data to be displayed in their associated windows are to be drawn;

ii. counter means for generating address signals that represent the addresses of the pixels whose data are currently being represented by the image-data signal;

iii. boundary registers, containing boundary data representing the locations of boundaries of the windows, for generating boundary signals that represent the boundary data;

iv. comparison means, connected to receive the address and boundary signals, for comparing the address and boundary signals to determine whether the current scan location falls in any of the windows and generating an ownership signal identifying such a window; and v. a selection-signal generator responsive to the ownership and source-selection signals to generate as the selection signal a signal designating the image-data source designated by the source-selection register associated with the window identified by an ownership signal; and D. a multiplexer, connected for reception of the imagedata-source and selection signals, for producing and applying to the image generator as the image-data signal a multiplexer output determined by the imagedata source signal generated by the image-data source that the selection signal designates.

8. A display system as defined in claim 7 further including validity means responsive to the comparison means to generate a validity signal that indicates whether, on the one hand, the current scan location falls in at least one of the windows or, on the other hand, it falls in none of the windows.

9. A display system comprising:

A. an image generator, including a display screen and adapted to receive an image-data signal representing image data, for scanning locations on the screen in an ordered manner in successive scan frames and displaying in the scanned screen locations pixels having pixel values determined by the image-data signal received concurrently with the scanning of the screen locations:

B. a plurality of image-data sources, each image-data source comprising means for generating an image-datasource signal containing image data representing pixels in a different respective image concurrently with the scanning by the image generator of locations corresponding to the locations of the represented pixels in the respective image;

C. a selection-signal source for generating a selection signal having a plurality of states, each state designating a respective image-data source, the selection-signal source including means for changing the selection-signal state in the midst of a scan frame, the selection-signal source comprising:

i. a plurality of source-selection registers, each source-selection register being associated with a different one of a plurality of windows, for generating source-selection signals that designate the image-data sources from which data to be displayed in their associated windows are to be drawn;

ii. counter means for generating address signals that represent the addresses of the pixels whose data are currently being represented by the image-data signal;

iii. boundary registers, containing boundary data representing the locations of boundaries of the windows that can overlap so that a given scan location can fall into more than one window, for generating boundary signals that represent the boundary data;

iv. comparison means, connected to receive the address and boundary signals, for comparing the address and boundary signals to determine whether the current scan location falls in any of the windows and generating ownership signals identifying all such windows simultaneously; and v. a selection-signal generator including priority means for assigning a predetermined priority to the windows and responsive to the ownership and sourceselection signals to generate as the selection signal a signal designating the image-data source designated by the source-selection register associated with the window that has the highest priority among these windows identified by ownership signals; and D. a multiplexer, connected for reception of the imagedata-source and selection signals, for producing and applying to the image generator as the image-data signal a multiplexer output determined by the imagedata-source signal generated by the image-data source that the selection signal designates.

10. A display system as defined in claim 9 further including validity means responsive to the comparison means to generate a validity signal that indicates whether, on the one hand, the current scan location falls in at least one of the windows or, on the other hand, it falls in none of the windows.

11. A display system comprising:

A. an image generator, including a display screen and adapted to receive an image-data signal representing image data, for scanning locations on the screen in an ordered manner in successive scan frames and displaying in the scanned screen locations pixels having pixel values determined by the image-data signal received concurrently with the scanning of the screen locations;

B. a plurality of image-data sources, each image-data source comprising means for generating an image-datasource signal containing image data representing pixels in a different respective image concurrently with the scanning by the image generator of locations corresponding to the locations of the represented pixels in the respective image;

C. a selection-signal source for generating a selection signal having a plurality of states, each state designating a respective image-data source, the selection-signal source including means for changing the selection-signal state in the midst of a scan frame, the selection-signal source comprising:

i. a plurality of source-selection registers, each source-selection register being associated with a different one of a plurality of windows, for generating source-selection signals that designate the image-data sources from which data to be displayed in their associated windows are to be drawn;

ii. counter means for generating address signals that represent the addresses of the pixels whose data are currently being represented by the image-data signal;

iii. read/write boundary registers, containing boundary data representing the locations of boundaries of the windows, which boundary data can be changed in change the positions of the windows on the display, for generating boundary signals that represent the boundary data;

iv. comparison means, connected to receive the address and boundary signals, for comparing the address and boundary signals to determine whether the current scan location falls in any of the windows and generating an ownership signal identifying such a window; and v. a selection-signal generator responsive to the ownership and source-selection signals to generate as the selection signal a signal designating the image-data source designated by the source-selection register associated with the window identified by an ownership signal; and D. a multiplexer, connected for reception of the imagedata-source and selection signals, for producing and applying to the image generator as the image-data signal a multiplexer output determined by the imagedata-source signal generated by the image-data source that the selection signal designates.

* * * * *